US008353672B2

(12) United States Patent
Townes et al.

(10) Patent No.: US 8,353,672 B2
(45) Date of Patent: Jan. 15, 2013

(54) TURBINE BLADE DAMPER ARRANGEMENT

(75) Inventors: Roderick M. Townes, Derby (GB); Caner H. Helvaci, Coventry (GB); Adrian J. Webster, Banbridge (IE)

(73) Assignee: Rolls-Royce, PLC, London (GB)

( * ) Notice: Subject to any disclaimer, the term of this patent is extended or adjusted under 35 U.S.C. 154(b) by 459 days.

(21) Appl. No.: 12/458,417

(22) Filed: Jul. 10, 2009

(65) Prior Publication Data

US 2010/0061854 A1 Mar. 11, 2010

(30) Foreign Application Priority Data

Sep. 10, 2008 (GB) ..... 0816467.5

(51) Int. Cl.
*F01D 11/00* (2006.01)

(52) U.S. Cl. ..... 416/193 A; 416/190

(58) Field of Classification Search ..... 416/190, 416/193 A, 500
See application file for complete search history.

(56) References Cited

U.S. PATENT DOCUMENTS 6,354,803 B1 3/2002 Grover et al.
7,163,376 B2 * 1/2007 Itzel et al. ..... 416/193 A

FOREIGN PATENT DOCUMENTS

EP 1 477 634 A2 11/2004
EP 1 867 836 A2 12/2007
JP A-2006-125372 5/2006

* cited by examiner

*Primary Examiner* — Dwayne J White
(74) *Attorney, Agent, or Firm* — Oliff & Berridge, PLC

(57) ABSTRACT

A turbine blade damper arrangement in which a damper is positioned against the undersides of the platforms of adjacent turbine blades. In operation, the damper is centrifugally urged into engagement with the blade platforms to provide damping of relative movement between the blades. The damper and platform surfaces that it engages are of part-cylindrical configuration in order to minimize gas leakage paths between the damper and blade platforms.

5 Claims, 3 Drawing Sheets

TURBINE BLADE DAMPER ARRANGEMENT

This invention concerns a turbine blade damper arrangement, and particularly a turbine blade damper for use in aircraft gas turbine engines.

Turbines in gas turbine engines comprise a plurality of turbine blades arranged circumferentially around a rotor. Each blade usually comprises an aerofoil extending between a radially inner platform and a radially outer shroud. A gap is generally provided between adjacent turbine blade platforms to avoid chocking or touching, which otherwise could lead to high cycle fatigue of the blades. Generally a damper has been provided to substantially seal this gap and also to dampen vibration between adjacent blades.

A number of prior damper arrangements have been used. Some of these have included the use of bars or plates, which may be deformable to improve sealing by conforming to adjacent surfaces.

One prior arrangement uses a "cottage roof damper" 10 as shown in FIGS. 1 and 2. The damper 10 is a profiled elongate member which in cross section has two inclined upper surfaces 2, each engageable against the underside of a respective blade platform 4, with the apex 6 between the surfaces 2 locating in a gap 8 between the two platforms 4. This arrangement has been found to provide good damping.

FIG. 1 indicates that the inner annulus line or the radially inner face 12 of the platform 4 is rising, ie extending outwardly towards the rear of the engine. The rear face 14 of the damper 4 that it engages and also blade platform is flat which results in only a small air leakage 15 due to manufacturing and assembly tolerances. There is a relatively large gap between the front face 16 of the damper 10 and the platforms 4 so that there is no damping in this region and additionally multiple air leakage occurs as indicated by the arrows 17. In use the damper 10 is self adjusting and tends to move outwardly and rearwardly.

There is a trend in future gas turbine engines to use a falling inner annulus line 18 as shown in FIG. 3. A damper 21 used with such an arrangement would be forced forwards and outwards by centrifugal force, leaving a clearance 20 at the rear as shown in FIG. 3. The clearance 20 at the rear is particularly penalising in terms of leakage as this location has a higher pressure drop than the front clearance.

According to the present invention there is provided a turbine blade damper arrangement, the arrangement including on each turbine blade on a first circumferential side a first part cylindrical contact surface on the inner side of the turbine platform, and on the opposite circumferential side a second flat inclined contact surface on the circumferential side of the turbine platform, the first contact surface being spaced from the second contact surface on an adjacent turbine blade, with the cylindrical axis of the first contact surface substantially perpendicular to the said second contact surface, and with the second contact surface inclined away from the turbine radial direction; an elongate damper being located between each adjacent pair of turbine blade platforms, the damper including a first part cylindrical engagement face engageable with the first contact surface, and a second flat engagement face substantially perpendicular to the axis of the first engagement face, which second engagement face is engageable with the second contact surface on an adjacent turbine blade.

The gap between adjacent turbine blades may be inclined away from the turbine radial direction.

The first contact surface on each turbine blade may be formed by a part cylindrical groove.

The dampers may be retained in place by a lock plate.

The dampers may be provided on the pressure surface side of the turbine blades.

Openings may be provided through the damper at one or more locations to provide cooling.

The invention also provides a gas turbine engine incorporating turbine blade damper arrangements according to any of the preceding six paragraphs.

An embodiment of the present invention will now be described by way of example only and with reference to the accompanying drawings in which:—

Figure 4:
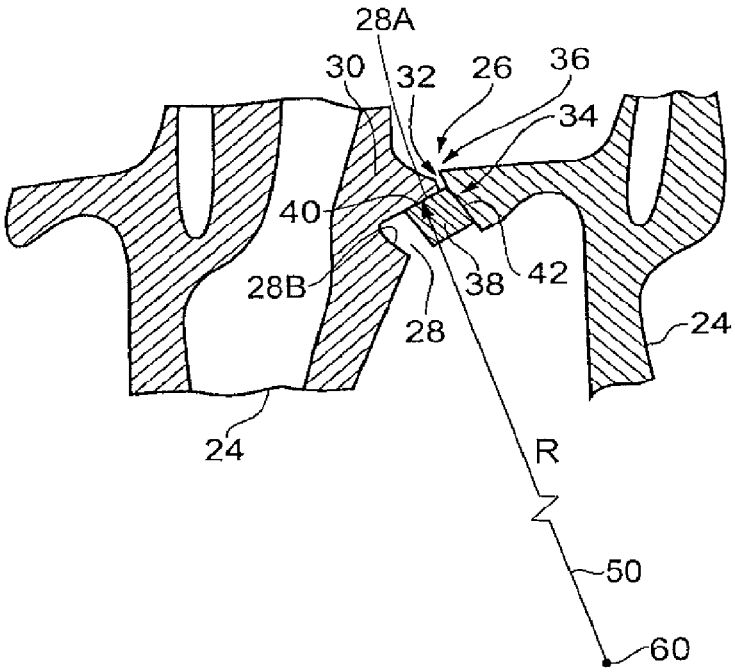
FIG. 4 is a diagrammatic circumferential cross-sectional view of part of a gas turbine engine including a turbine blade damper arrangement according to the invention.
Figure 5:
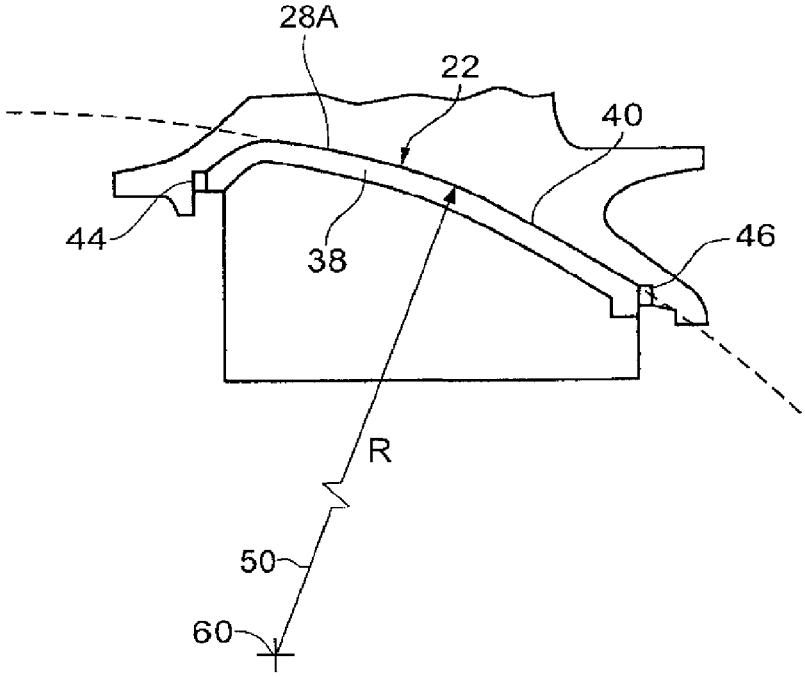
FIG. 5 is an axial cross-sectional view of the turbine blade damper arrangement of FIG. 4.

FIGS. 4 and 5 show part of a gas turbine engine with a falling inner annulus line 22 in the turbine. FIG. 4 shows two adjacent turbine blades 24 and the damper arrangement 26 therebetween, and it is to be appreciated that such an arrangement 26 will be repeated around the turbine between each adjacent pair of turbine blades 24.

On the left hand turbine blade 24 as shown in FIG. 4, a part cylindrical groove 28, partly defined by a first, part cylindrical contact surface 28A and a second, substantially radial surface 28B, is provided on the inside of a right hand most part 30 of the blade 24. The part cylindrical contact surface 28A is defined by an arc 50, the arc 50 having a radius R and a center 60. Moving outwardly from the groove at the right hand edge of the blade 24 an edge 32 is provided which is perpendicular to the axis of the groove 28.

The right hand blade 24 as shown in FIG. 4 has an inclined edge 34 facing the left hand blade 24 which is parallel to the edge 32 on the left hand blade 24, and extends inwardly beyond the groove 28, thereby defining an inclined space 36 between the blades 24, which space 36 is inclined relative to the radial direction of the turbine.

An elongate damper 38 is mounted to the left hand blade 24 by a rear lug and front lock plate (both not shown). The damper 38 has a part cylindrical engagement face 40 which corresponds to the shape of the part cylindrical groove 28 to engage therewith. The damper 38 has a second flat engagement face 42 which is perpendicular to the axis of the part cylindrical engagement face 40, and which second engagement face 42 is engagement against the edge 34 of the right hand blade 24.

In use the damper 38 functions in a similar manner to a cottage roof damper 10. During running of the engine, centrifugal forces will move the damper 10 off the lock plate and lug against the groove 28. The centrifugal load will supply a reaction to the damper contact faces 40, 42, creating friction and therefore damping during blade to blade movement due to vibration.

Figure 1:
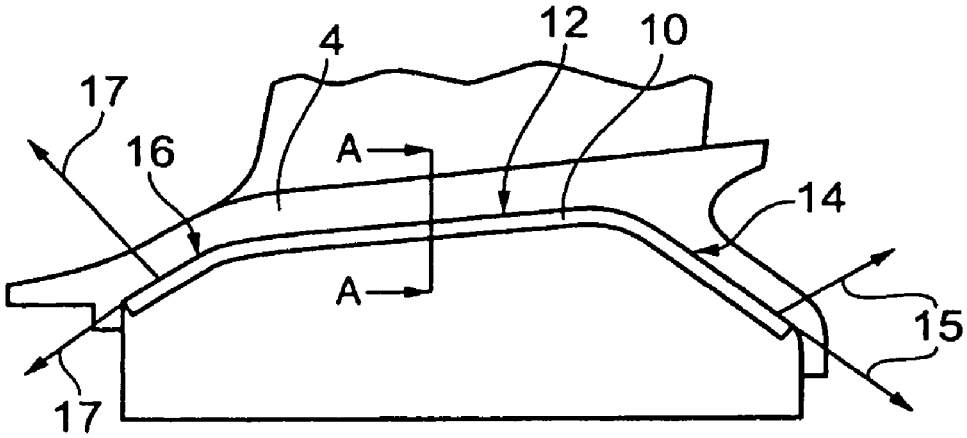
FIG. 1 Prior Art
FIG. 1 is an axial cross-sectional view of part of a prior gas turbine engine showing a turbine blade damper arrangement.
Figure 2:
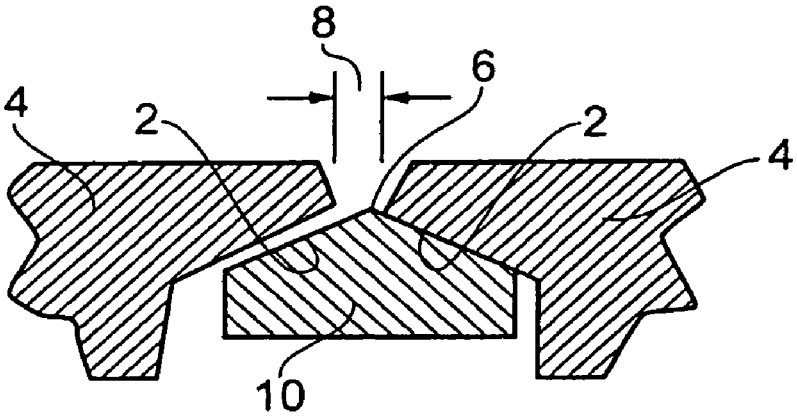
FIG. 2 Prior Art
FIG. 2 is a circumferential cross-sectional view along the line A-A of FIG. 1.
Figure 3:
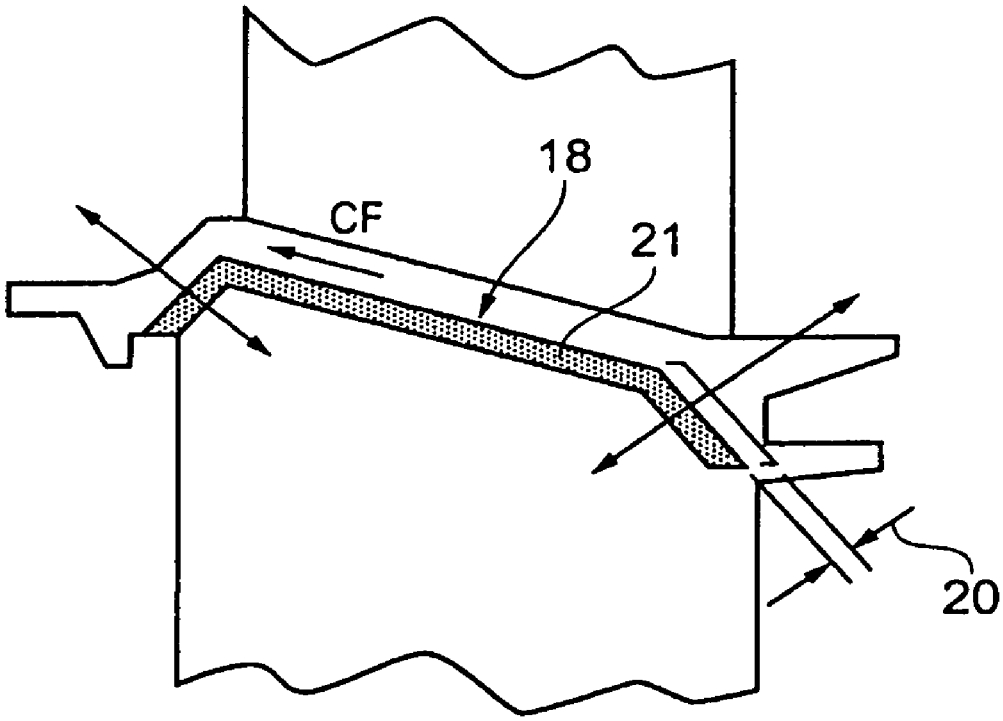
FIG. 3 Prior Art
FIG. 3 is a diagrammatic axial cross-sectional view of a further prior gas turbine engine showing a turbine blade damper arrangement.

The damper 38 should retain substantially full face contact with the blades 24 during relative axial and tangential movements therebetween through rotation and translation of the cylindrical face. These are the expected platform movements from blade modal vibration. This being the case the leakage areas formed by movement of the damper under centrifugal forces will reduce the leakage to paths as shown at 44 and 46 in FIG. 5, which are reduced when compared to the multiple leakage paths 48 in a standard cottage roof damper 10 as shown in FIG. 1.

In analysis, dampers according to the invention have provided at least as effective damping as standard cottage roof dampers, and have also provided reduced leakage from the air system.

Various modifications may be made without departing from the scope of the invention. Whilst the invention is illustrated under the pressure surface (concave) side of a blade, the invention could be applied to the suction surface (convex) side of the blade. The damper could be mounted to the blade in a different manner. It may be possible to provide slots or other high temperature cooling increasing features such as turbulators or pedestals in the damper, to provide additional cooling to specific regions of the platform.

The invention claimed is:

1. A turbine blade damper arrangement for providing clamping between turbine blades, the arrangement including a first, part cylindrical, contact surface, on a first circumferential side of each turbine blade, on an inner side of a turbine platform, and a second, flat, inclined contact surface, on an opposite circumferential side of each turbine blade, on the circumferential side of an adjacent turbine platform, the first contact surface being spaced from the second contact surface on an adjacent turbine blade, with a cylindrical axis of the first contact surface being substantially perpendicular to the second contact surface, and with the second contact surface being inclined away from the turbine radial direction; and an elongate damper being located between each adjacent pair of turbine blade platforms, the damper including a first, part cylindrical, engagement face engageable with the first contact surface, and a second, flat, engagement face substantially perpendicular to the axis of the first engagement face, which second engagement face is engageable with the second contact surface on an adjacent turbine blade.

2. The arrangement according to claim 1, wherein a gap is defined between adjacent turbine blades and is inclined away from the turbine radial direction.

3. The arrangement according to claim 1, wherein the first contact surface on each turbine blade is formed by a part cylindrical groove.

4. The arrangement according to claim 1, wherein the damper is provided on a pressure surface side of the turbine blades.

5. A gas turbine engine incorporating the turbine blade damper arrangements according to claim 1.

* * * * *